US008801411B2

(12) United States Patent
Mori

(10) Patent No.: US 8,801,411 B2
(45) Date of Patent: Aug. 12, 2014

(54) INTERNAL-GEAR TYPE FLUID DEVICE

(75) Inventor: Osamu Mori, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 282 days.

(21) Appl. No.: 13/241,482

(22) Filed: Sep. 23, 2011

(65) Prior Publication Data

US 2012/0082579 A1 Apr. 5, 2012

(30) Foreign Application Priority Data

Sep. 30, 2010 (JP) ..... 2010-221759

(51) Int. Cl.
*F04C 2/00* (2006.01)

(52) U.S. Cl.
USPC ..... 418/166; 418/168; 418/190; 418/61.3

(58) Field of Classification Search
USPC ..... 418/61.1, 61.3, 166, 168, 180, 189, 190
See application file for complete search history.

(56) References Cited

U.S. PATENT DOCUMENTS

| | | | | |
|---|---|---|---|---|
| 2,286,031 | A * | 6/1942 | Bowering | 418/190 |
| 2,344,628 | A * | 3/1944 | Monahan | 418/190 |
| 7,963,754 | B2 * | 6/2011 | Hansen et al. | 418/61.3 |
| 2007/0092392 | A1 * | 4/2007 | Kurokawa | 418/61.3 |

FOREIGN PATENT DOCUMENTS

JP 2005-188380 7/2005

* cited by examiner

*Primary Examiner* — Thai Ba Trieu
*Assistant Examiner* — Thomas Olszewski
(74) *Attorney, Agent, or Firm* — Smith, Gmabrell & Russell, LLP.

(57) ABSTRACT

In an internal-gear type fluid device, guide teeth are formed by inner teeth at an outer rotor, and vane portions extending in the width direction are formed at tooth tip portions of the guide teeth. Further, guide teeth are formed by outer teeth at the inner rotor, and vane portions extending in the width direction are formed at tooth tip portions of the guide teeth. Since the vane portions are thus formed at the outer rotor and the inner rotor, the confinement timing when oil confinement is completed can be synchronized with the release timing when oil release is started, by adjusting, for example, the thickness of the vane portions without changing the profile of the guide teeth.

9 Claims, 8 Drawing Sheets

(a)
(b)
10
Discharge stroke
Intake stroke
Confinement stroke
A
A
11
12
13
14
14a
15
16
17
18,22
19,32
20(P1)
20(P2)
20(P3)
20(P4)
20(P5)
20(P6)
20(P7)
20(P8)
20(P9)
23
24
25,25a
33
34
35,35a
Oa
Ob
α

INTERNAL-GEAR TYPE FLUID DEVICE

CROSS-REFERENCE TO RELATED APPLICATIONS

The present application claims priority from Japanese Patent Application No. 2010-221759 filed on Sep. 30, 2010, the entire contents of which are hereby incorporated by reference.

BACKGROUND OF THE INVENTION

1. Field of the Invention

The present invention relates to an internal-gear type fluid device that includes an outer rotor and an inner rotor.

2. Description of the Related Art

A fluid motor in which an inner rotor is driven using a pumped fluid and a fluid pump in which an inner rotor is driven to discharge a fluid have been disclosed as internal-gear type fluid devices that include an outer rotor and an inner rotor. For example, the fluid pump has a plurality of pumping chambers between the outer rotor and the inner rotor, and the volume of each chamber is increased or decreased by rotating the inner rotor, thereby pumping a fluid such as oil from an intake port to a discharge port.

In such a fluid pump, the volume of the pumping chamber decreases following the rotation of the rotor even after the fluid has been confined in the pumping chamber, thereby causing an excessive increase in the pressure inside the pumping chamber. When the pumping chamber thereafter communicates with the discharge port, the pressure inside the pumping chamber drops rapidly, and, therefore, cavitation occurs inside the pumping chamber. The cavitation causes noise and vibrations and decreases the pumping efficiency.

Accordingly, a fluid pump has been disclosed (see, for example, Japanese Unexamined Patent Application Publication No. 2005-188380) in which cutouts are formed in the teeth surfaces of the outer and inner rotors, and the pumping chambers are communicated via the cutouts, thereby causing the fluid to move between the pumping chambers. As a result, pressure fluctuations inside the pumping chambers are inhibited and the occurrence of cavitation is suppressed.

However, in the fluid pump described in Japanese Unexamined Patent Application Publication No. 2005-188380, although the pumping chambers are communicated with one another via fine cutouts, the pumping chamber volume decreases from the confinement of the fluid has been completed to the release of the fluid. Such a decrease in the pumping chamber volume before the fluid is released to the discharge chamber causes an excessive increase in pressure, and therefore, the occurrence of cavitation is difficult to prevent.

SUMMARY OF THE INVENTION

The present invention aims to suppress the occurrence of cavitation in an internal-gear type fluid device.

An internal-gear type fluid device according to an aspect of the present invention includes: a housing provided with an inlet port and an outlet port; an outer rotor rotatably housed in the housing; and an inner rotor installed inside the outer rotor. In the an internal-gear type fluid device, a plurality of fluid chambers defined between the outer rotor and the inner rotor move to be subjected to in an inlet stroke in which the fluid chambers communicate with the inlet port thereby enlarging the chamber volume, an outlet stroke in which the fluid chambers communicate with the outlet port thereby reducing the chamber volume, and a confinement stroke which is positioned between the inlet stroke and the outlet stroke and in which the volume is at a maximum. At least either one of an inner circumferential portion of the outer rotor and an outer circumferential portion of the inner rotor has guide teeth constituted by inner teeth or outer teeth continuous in a circumferential direction, the guide teeth being configured have a width less than that of the rotor. Vane portions are formed to extend in a width direction from tooth tip portions of the guide teeth to an end surface of the rotor. Before a volume of a fluid chamber in the confinement stroke reaches a maximum, the fluid chamber in the confinement stroke and a fluid chamber in the intake stroke communicate with each other via a space between the vane portions disposed with a predetermined spacing in the circumferential direction, but the fluid chamber in the confinement stroke and the fluid chamber in the outlet stroke are cut off from each other by the vane portion. When the volume of the fluid chamber in the confinement stroke reaches the maximum, the fluid chamber in the confinement stroke and the fluid chamber in the outlet stroke are cut off from each other by the vane portion, and the fluid chamber in the confinement stroke and the fluid chamber in the inlet stroke are cut off from each other by the vane portion. After the volume of fluid chamber in the confinement stroke reaches the maximum, the fluid chamber in the confinement stroke and the fluid chamber in the inlet stroke are cut off from each other by the vane portion, but the fluid chamber in the confinement stroke and the fluid chamber in the outlet stroke communicate with each other via the space between the vane portions.

In the internal-gear type fluid device according to the present invention, it is preferable that an end surface of the vane portion extending radially from the rotor be formed at a tooth tip position identical to a tooth tip position of the guide tooth.

In the internal-gear type fluid device in accordance with the present invention, it is preferable that the plurality of fluid chambers disposed in the inlet stroke communicate with one another via spaces between the vane portions, and the plurality of fluid chambers disposed in the outlet stroke communicate with one another via spaces between the vane portions.

In the internal-gear type fluid device in accordance with the present invention, the vane portions are formed at both the outer rotor and the inner rotor.

In the internal-gear type fluid device in accordance with the present invention, the vane portion is formed to extend to both sides in the width direction from the tooth tip portion.

According to the present invention, the vane portions are formed in addition to the guide teeth constituted by the inner teeth or outer teeth on at least either one of the outer rotor and the inner rotor. Therefore, the confinement timing when the confinement of fluid in the fluid chamber is completed is synchronized with the release timing when the fluid release from the fluid chamber is started. Thus, the confinement timing and the release timing can be adjusted by adjusting, for example, the thickness of the vane portions, without changing the profile of the inner teeth or the outer teeth constituting the guide teeth. Therefore, the confinement timing and release timing can be easily synchronized. As a result, variations in volume in a tightly closed state of the fluid chambers can be avoided, pressure fluctuations inside the fluid chambers can be inhibited, and the occurrence of cavitation can be prevented.

DESCRIPTION OF THE PREFERRED EMBODIMENTS

Figure 1:
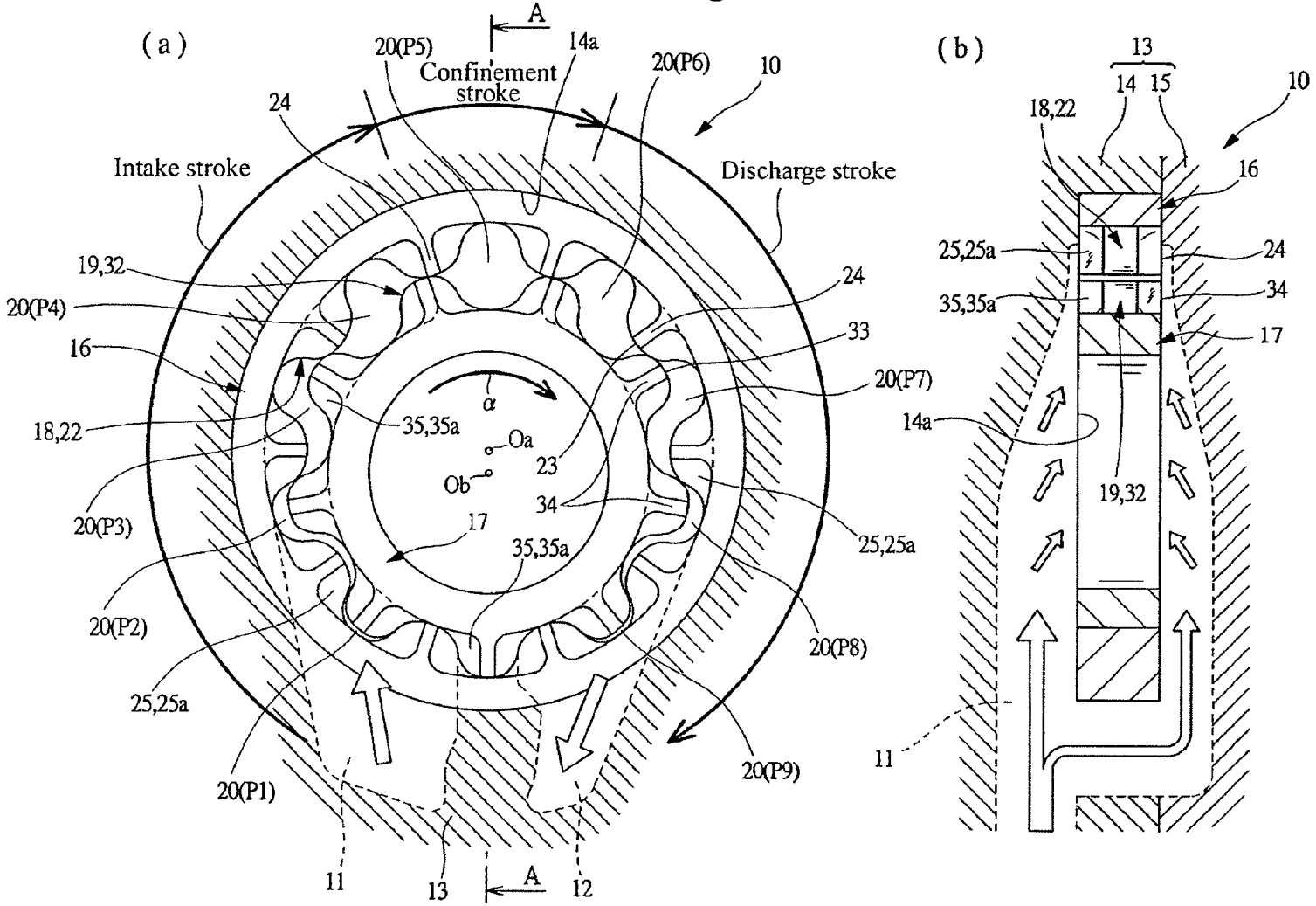
FIG. 1A is a side view illustrating an oil pump as an internal-gear type fluid device according to an embodiment of the present invention.
FIG. 1B is a cross-sectional view that is taken along the A-A line in FIG. 1A and illustrates the oil pump.

Embodiments of the present invention will be described below with reference to the appended drawings. FIG. 1A is a side view illustrating an oil pump 10 as an internal-gear type fluid device that is an embodiment of the present invention. FIG. 1B is a cross-sectional view that is taken along the A-A line in FIG. 1A and illustrates the oil pump 10. As shown in FIGS. 1A and 1B, the oil pump 10 has a housing 13 having an intake port (inlet port) 11 and a discharge port (outlet port) 12 formed therein. The housing 13 is constituted by a housing main body 14 provided with a rotor accommodation portion 14*a* and a housing cover 15 closing an opening of the housing main body 14. An outer rotor (rotor) 16 rotating about a point Oa is rotatably accommodated in the rotor accommodation portion 14*a* of the housing 13. An inner rotor (rotor) 17 rotating about a point Ob is accommodated on the inner side of the outer rotor 16.

Inner teeth 18 constituting below-described guide teeth 22 are formed at the outer rotor 16, and outer teeth 19 constituting below-described guide teeth 32 are formed at the inner rotor 17. The inner teeth 18 of the outer rotor 16 and the outer teeth 19 of the inner rotor 17 are meshed together. The inner rotor 17 is rotated by a power source (not shown in the figure) in the direction of an arrow a (clockwise direction), whereby the outer rotor 16 can be rotated in the same direction as the inner rotor 17. A plurality of pumping chambers 20 (referred to hereinbelow as chambers) is defined as fluid chambers between such outer rotor 16 and inner rotor 17.

As the outer rotor 16 and the inner rotor 17 rotate, these chambers 20 move in the circumferential direction, changing the volume thereof. As shown in FIG. 1A, in an intake stroke (inlet stroke), the chambers 20 move, while the volume thereof is expanded, in the sequence represented by reference symbols P1, P2, P3 and P4. Further, in a confinement stroke in which the tooth tips of the outer rotor 16 and inner rotor 17 face one another, as shown by reference symbol P5, the volume of chambers 20 is expanded to a maximum value. Then, in a discharge stroke (outlet stroke), the chambers 20 move, while the volume thereof is reduced, in the sequence represented by reference symbols P6, P7, P8 and P9. The volume of each chamber 20 thus changes, while the chamber moves in the sequence of the intake stroke, confinement stroke, and discharge strokes.

Figure 2:
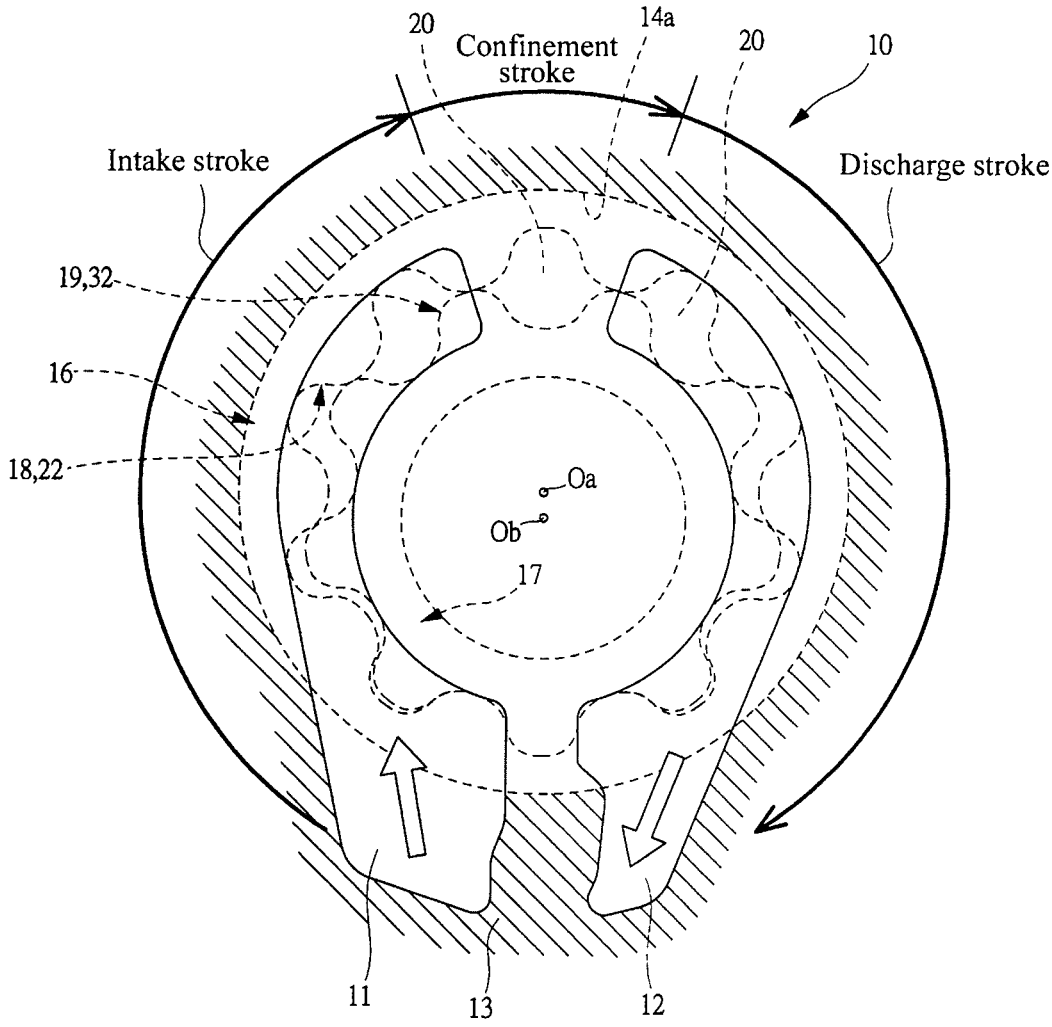
FIG. 2 is an explanatory drawing illustrating the formation positions of an intake port and a discharge port.

FIG. 2 is an explanatory drawing illustrating the formation positions of the intake port 11 and the discharge port 12. As shown by a solid line in FIG. 2, the intake port 11 is formed to be open at a position corresponding to the intake stroke of the chamber 20. Thus, the intake port 11 is formed at a position to communicate with the chamber 20 in which the volume expands gradually. Further, the discharge port 12 is formed to open at a position corresponding to the discharge stroke of the chamber 20. Thus, the discharge port 12 is formed at a position to communicate with the chamber 20 in which the volume decreases gradually. As a result, as shown by white arrows in FIG. 1, in the intake stroke, the oil corresponding to the volume expansion of the chamber 20 is sucked in from the intake port 11, and in the discharge stroke, the oil corresponding to volume reduction of the chamber 20 is discharged from the discharge port 12. In the oil pump 10 shown in the figure, the intake port 11 and the discharge port 12 are formed in both the housing main body 14 and the housing cover 15. However, the present invention is not limited to such a configuration, and the intake port 11 or the discharge port 12 may be formed in either one of the housing main body 14 and the housing cover 15.

Figure 3:
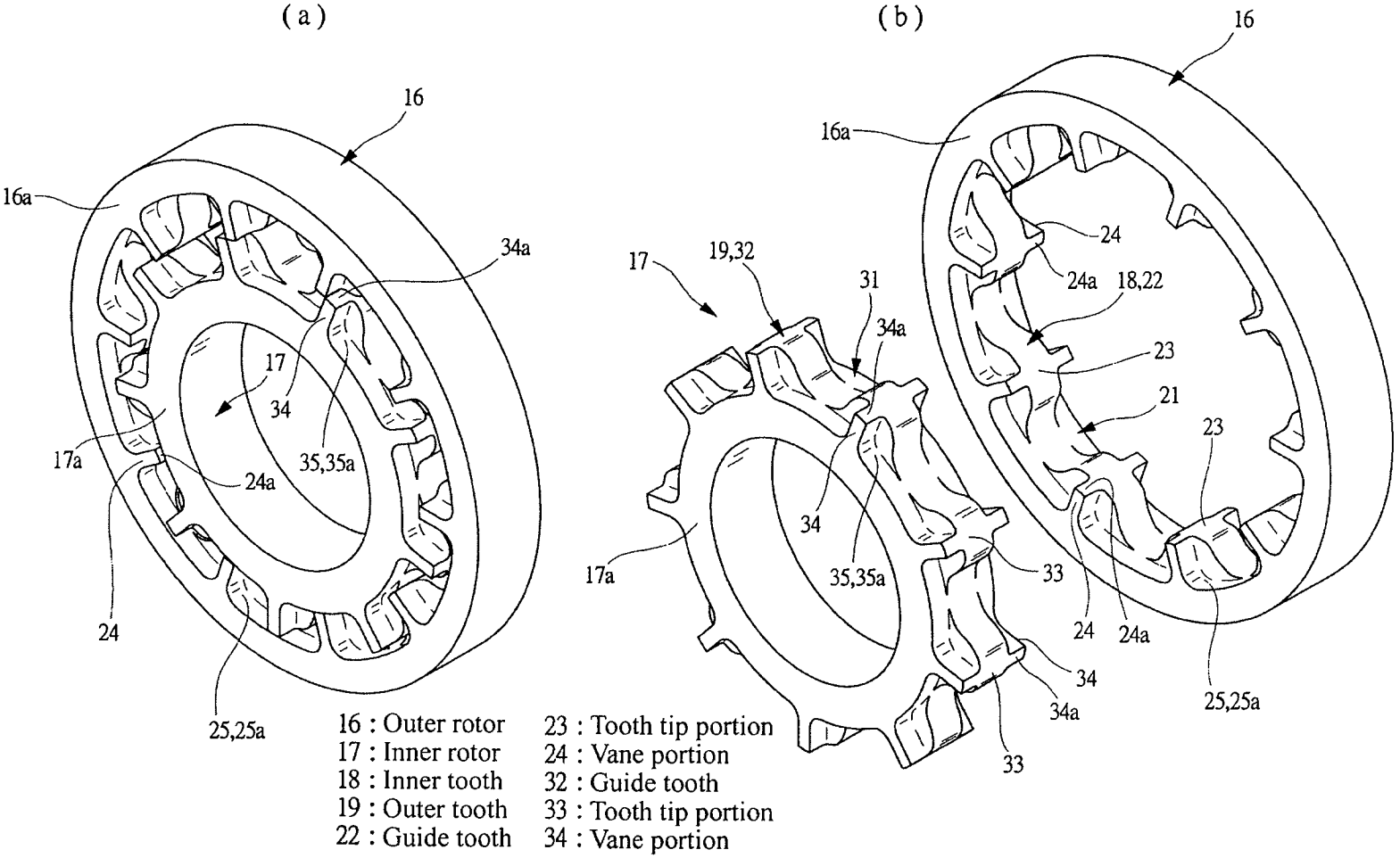
FIG. 3A is a perspective view illustrating a state in which an inner rotor is installed in an outer rotor.
FIG. 3B is an exploded perspective view illustrating the outer rotor and the inner rotor.

FIG. 3A is a perspective view illustrating a state in which the inner rotor 17 is installed in the outer rotor 16. FIG. 3B is an exploded perspective view illustrating the outer rotor 16 and the inner rotor 17. As shown in FIGS. 3A and 3B, guide teeth 22 are formed by inner teeth 18, which are continuous in the circumferential direction, at an inner circumferential portion 21 of the outer rotor 16. The guide teeth 22 are formed to have a width less than that of the outer rotor 16, and the tooth surface of the guide teeth 22 has a trochoid profile. A vane portion 24 extending in the width direction to an end surface 16*a* of the outer rotor 16 is formed at each tooth tip portion 23 of the guide teeth 22. The vane portions 24 are formed to extend to both sides in the width direction from the guide teeth 22. Thus, a pair of vane portions 24 are formed to extend in both directions from each tooth tip portion 23 of the guide teeth 22. Further, an end surface 24*a* of the vane portion 24 that extends radially inward from the inner circumferential portion 21 of the outer rotor 16 is formed to extend to the tooth tip position identical to that of the tooth tip portion 23 of the guide tooth 22. Thus, a plurality of vane portions 24 that are arranged with a predetermined spacing in the circumferential direction are formed at the outer rotor 16, and cutout portions 25 provided with spaces 25*a* are formed adjacent to the end surfaces of the guide teeth 22 between the vane portions 24. The bottom position of the guide tooth 22 of the outer rotor 16 and the position of the bottom surface of the cutout portion 25 are at the same height.

Likewise, guide teeth 32 are formed by outer teeth 19, which are continuous in the circumferential direction, at an outer circumferential portion 31 of the inner rotor 17. The guide teeth 32 are formed to have a width less than that of the inner rotor 17, and the tooth surface of the guide teeth 32 has a trochoid profile. A vane portion 34 extending in the width direction to an end surface 17*a* of the inner rotor 17 is formed at each tooth tip portion 33 of the guide teeth 32. The vane portions 34 are formed to extend to both sides in the width direction from the guide teeth 32. Thus, a pair of vane portions 34 are formed to extend in both directions from each tooth tip portion 33 of the guide tooth 32. Further, an end surface 34*a* of the vane portion 34 that extends radially outward from the outer circumferential portion 31 of the inner rotor 17 is formed to extend to the tooth tip position identical to that of the tooth tip portion 33 of the guide tooth 32. Thus, a plurality of vane portions 34 that are arranged with a predetermined spacing in the circumferential direction are formed at the inner rotor 17, and cutout portions 35 provided with spaces 35*a* are formed adjacent to the end surfaces of the guide tooth 32 between the vane portions 34. The bottom position of the guide tooth 32 of the inner rotor 17 and the position of the bottom surface of the cutout portion 35 are at the same height.

Figure 4:
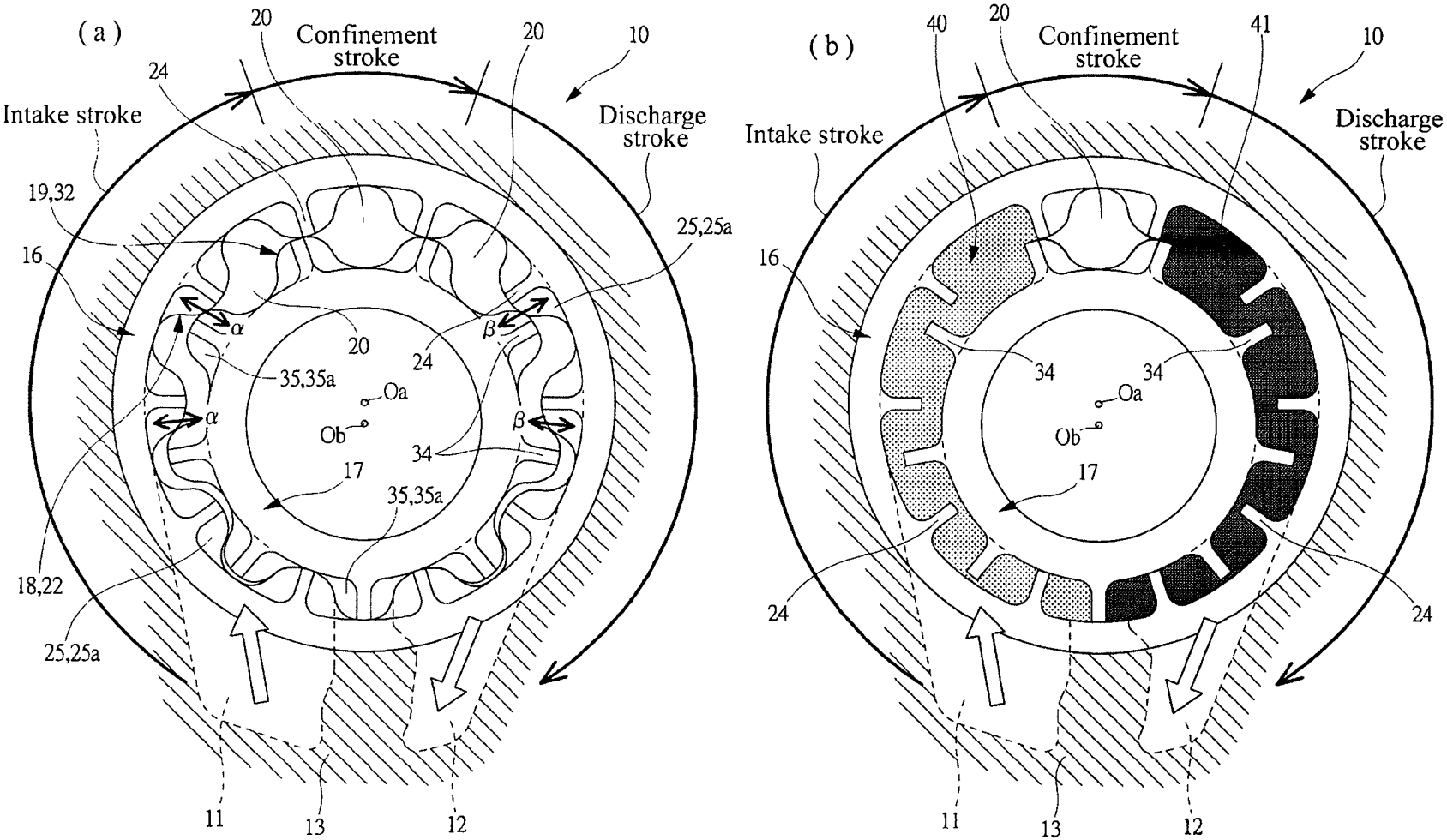
FIGS. 4A and 4*b* are explanatory drawings illustrating the communication state of chambers.

By forming the outer rotor 16 and the inner rotor 17 in the above-described manner, it is possible to communicate the plurality of chambers 20 disposed in the intake stroke with one another and communicate the plurality of chambers 20 disposed in the discharge stroke with one another. In this case, FIGS. 4A and 4B are explanatory drawings illustrating the communication state of the chambers 20. First, as shown in FIG. 4A, in the intake stroke, the vane portions 24 and 34 of the outer rotor 16 and inner rotor 17 are not opposed to each other and, therefore, as shown by an arrow a, the chambers 20 communicate with one another through the spaces 25*a* and 35*a* of the cutout portions 25 and 35 of the outer rotor 16 and inner rotor 17. Thus, as shown by painting out in FIG. 4B, the chambers 20 disposed in the intake stroke function as a chamber group 40 in which chambers communicate with one another. Likewise, in the discharge stroke, the vane portions 24 and 34 of the outer rotor 16 and inner rotor 17 are not opposed to each other and, therefore, as shown by an arrow β, the chambers 20 communicate with one another through spaces 25*a* and 35*a* of the cutout portions 25 and 35 of the outer rotor 16 and inner rotor 17. Thus, as shown by hatching in FIG. 4B, the chambers 20 disposed in the discharge stroke function as a chamber group 41 in which chambers communicate with one another.

Since the chambers 20 disposed in the intake stroke are thus caused to function as the chamber group 40 in which chambers communicate with one another, pressure fluctuations in the intake port 11 can be inhibited. Thus, because the chamber group 40 ensures a large volume, a volume variation ratio during volume expansion is reduced and oil can be sucked in smoother than in the case in which the volume of individual chambers 20 changes independently from the volume of another chamber. Likewise, since the chambers 20 disposed in the discharge stroke are thus caused to function as the chamber group 41 in which chambers communicate with one another, pressure fluctuations in the discharge port 12 can be inhibited. Thus, because the chamber group 41 ensures a large volume, a volume variation ratio during volume contraction is reduced and oil can be discharged smoother than in the case in which the volume of individual chambers 20 changes independently from the volume of another chamber. Further, since the outer rotor 16 and the inner rotor 17 are provided with the cutout portions 25 and 35 having the spaces 25*a* and 35*a*, the spaces 25*a*, 35*a* of the cutout portions 25 and 35 communicate with the intake port 11 or discharge port 12. As a result, the oil can be introduced into the chambers 20 from the intake port 11 via the spaces 25*a* and 35*a*. Since the oil can thus be smoothly guided via the spaces 25*a* and 35*a*, pressure fluctuations in the intake port 11 and discharge port 12 can be inhibited. Since pressure fluctuations during oil intake and oil discharge can thus be inhibited, the occurrence of cavitation can be suppressed. Further, by suppressing the occurrence of cavitation, it is possible to increase the pumping efficiency of the oil pump 10 and suppress noise of the oil pump 10.

Figure 5:
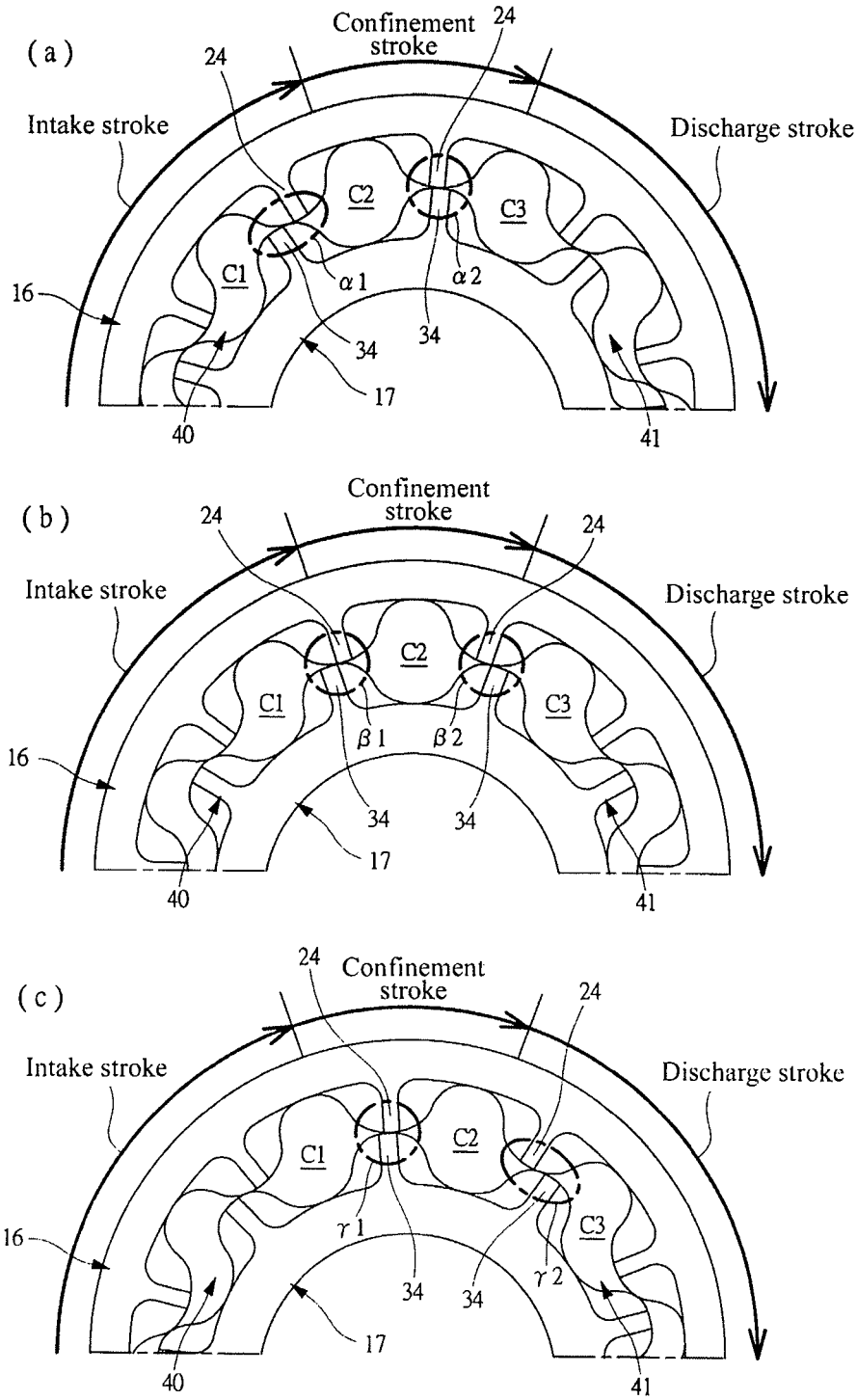
FIG. 5A to 5C are explanatory drawings illustrating a chamber disposed in a confinement stroke and the vicinity of the chamber.

Further, since the vane portions 24 and 34 are provided in the outer rotor 16 and inner rotor 17, the timing when the chamber group 40 on the intake side is cut off from the chambers 20 disposed in the confinement stroke can be synchronized with the timing when the chamber group 41 on the discharge side is communicated with the chambers 20 disposed in the confinement stroke. FIGS. 5A to 5C are explanatory drawings showing the chambers 20 disposed in the confinement stroke and the vicinity of these chambers. In the explanation below, the chamber 20 disposed in the confinement stroke is referred to as chamber C2, the chamber 20 disposed on the intake side of the chamber C2 is referred to as chamber C1, and the chamber 20 disposed on the discharge side of the chamber C2 is referred to as chamber C3.

As shown in FIG. 5A, immediately before the volume of the chamber C2 disposed in the confinement stroke reaches a maximum, the vane portions 24 and 34 positioned between the chamber C2 and the chamber C1 shift away from each other in the circumferential direction as shown by reference symbol α1, and therefore, the chamber C2 and the chamber group 40 disposed on the intake side communicate with each another. By contrast, the vane portions 24 and 34 positioned between the chamber C2 and the chamber C3 are opposed to each other as shown by reference symbol a2 and, therefore, the chamber C2 and the chamber group 41 disposed on the discharge side are cut off from each other. Thus, immediately before the volume of the chamber C2 reaches the maximum, the chamber C2 communicates only with the chamber group 40.

When the inner rotor 17 and the outer rotor 16 rotate from the positions shown in FIG. 5A, and the volume of the chamber C2 reaches a maximum as shown in FIG. 5B, the vane portions 24 and 34 positioned between the chamber C2 and the chamber C1 are opposed to each other as shown by reference symbol β1, and therefore, the chamber C2 and the chamber group 40 disposed on the intake side are cut off from one another. Further, since the vane portions 24 and 34 positioned between the chamber C2 and the chamber C3 are opposed to each other as shown by reference symbol β2, the chamber C2 and the chamber group 41 disposed on the discharge side are cut off from each other. Thus, when the chamber C2 has the maximum volume, the chamber C2 is cut off from both chamber groups 40 and 41.

Immediately after the inner rotor 17 and the outer rotor 16 have rotated from the positions shown in FIG. 5B, and the chamber C2 has a maximum volume, as shown in FIG. 5C, the vane portions 24 and 34 of the chamber C2 and the chamber C1 are opposed to each other as shown by reference symbol γ1, and, therefore, the chamber C2 and the chamber group 40 on the intake side are cut off from each other. By contrast, since the vane portions 24 and 34 positioned between the chamber C2 and chamber C3 shift away from each other in the circumferential direction as shown by reference symbol γ2, the chamber C2 and the chamber group 41 on the discharge side communicate with each other. Thus, immediately after the volume of the chamber C2 has reached the maximum, the chamber C2 communicates only with the chamber group 41 on the discharge side.

Thus, when the inner rotor 17 and the outer rotor 16 rotate, the communication destination of the chamber C2 is switched from the chamber group 40 on the intake side to the chamber group 41 on the discharge side at the timing when the volume of the chamber C2 reaches the maximum. Thus, the confinement timing when the confinement of oil in the chamber C2 is completed and the release timing when the release of oil from the chamber C2 is started can be synchronized with each other. As a result, pressure fluctuations inside the chamber C2 can be inhibited, and the occurrence of cavitation can be prevented, with the chamber C2 being maintained tightly closed and without inducing volume expansion or volume contraction of the chamber C2. As a result, pumping efficiency of the oil pump 10 can be increased and noise of the oil pump 10 can be inhibited. Furthermore, since the chamber C2 and the chamber group 40 on the intake side are cut off from each other at the timing when the volume of the chamber C2 reaches the maximum, oil in an amount corresponding to the theoretic volume can be caught inside the chamber C2, and pumping efficiency of the oil pump 10 can be increased.

In conventional oil pumps, such synchronization of the confinement timing when the confinement of oil in the chamber C2 is completed and the release timing when the release of oil from the chamber C2 is started is extremely difficult. Thus, in the conventional oil pump, in order to adjust the confinement timing or release timing, it is necessary to adjust the phase of the intake port final position and the phase of the discharge port opening position, or to change the profile of the inner or outer teeth. However, it is extremely difficult to change the profile of inner or outer teeth since it directly affects pump performance. On the other hand, in the oil pump 10 according to the present invention, in addition to the guide teeth 22 and 32 constituted by the inner teeth 18 or outer teeth 19, the vane portions 24 and 34 are formed at the outer rotor 16 and inner rotors 17. As a result, the confinement timing or release timing can be adjusted and the timings can be easily synchronized by adjusting the thickness of the vane portions 24 and 34, without changing the profile of the inner teeth 18 or the outer teeth 19.

Figure 6:
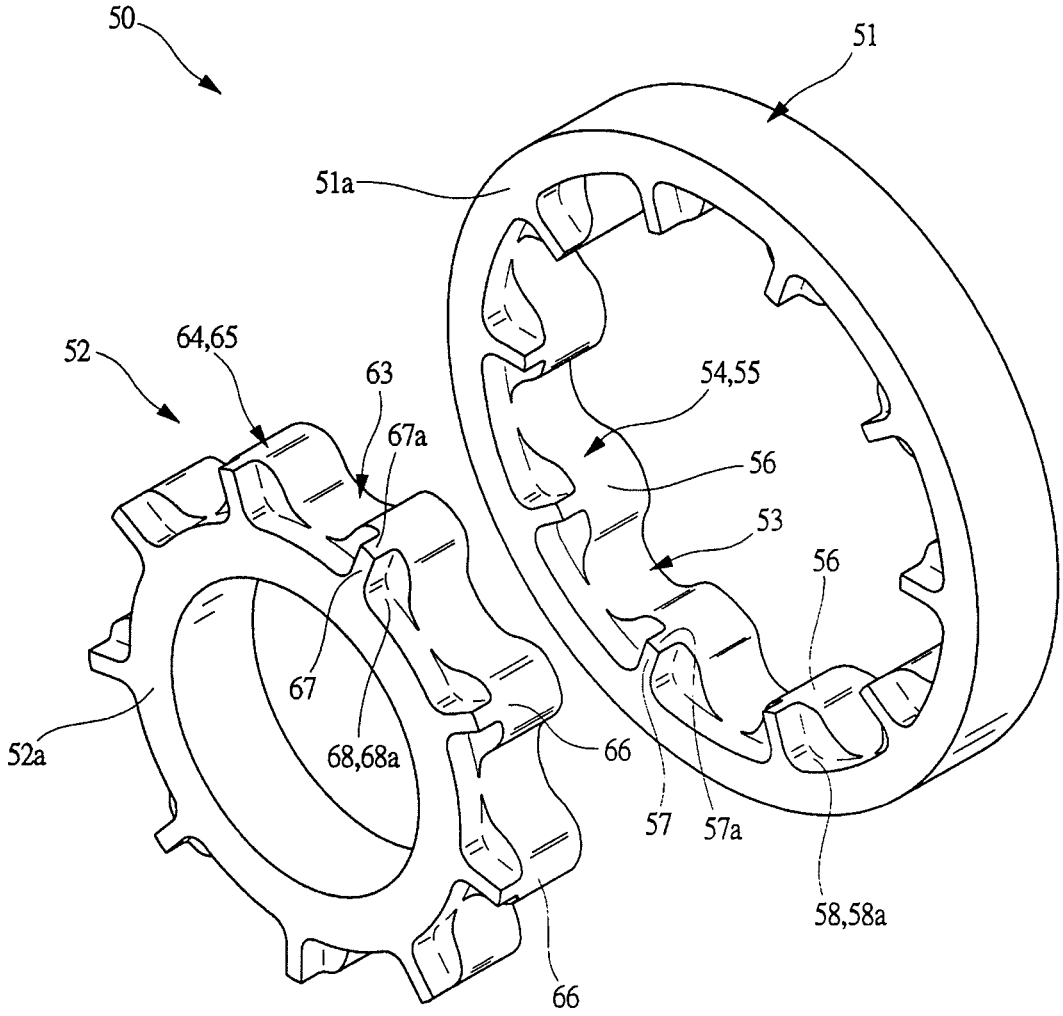
FIG. 6 is an exploded perspective view of an outer rotor and an inner rotor provided in an oil pump (internal-gear type fluid device) that is another embodiment of the present invention.

In the explanation above, a pair of vane portions 24 and 34 are formed to extend to both sides from the tooth tip portions 23 and 33 of the guide teeth 22 and 32 However, the present invention is not limited to such configuration, and the vane portions 24 and 34 may be formed to extend only to one side from the tooth tip portions 23 and 33 of the guide teeth 22 and 32. FIG. 6 is an exploded perspective view illustrating an outer rotor (rotor) 51 and an inner rotor (rotor) 52 provided in an oil pump (internal-gear type fluid device) 50 that is another embodiment of the present invention.

As shown in FIG. 6, guide teeth 55 are formed at an inner circumferential portion 53 of an outer rotor 51 by inner teeth 54, which are continuous in the circumferential direction. The width of the guide teeth 55 is less than the width of the outer rotor 51, and the guide teeth 55 are formed to extend in the width direction to one end surface of the outer rotor 51. The tooth surface of the guide teeth 55 has a trochoid profile. Further, a vane portion 57 extending in the width direction to the other end surface 51*a* of the outer rotor 51 is formed at each tooth tip portion 56 of the guide teeth 55. An end surface 57*a* of the vane portion 57 extending radially inward from the inner circumferential portion 53 of the outer rotor 51 is formed to extend to the tooth tip position identical to that of the tooth tip portion 56 of the guide teeth 55. A plurality of the vane portions 57 arranged with a predetermined spacing in the circumferential direction are thus formed at the outer rotor 51, and cutout portions 58 provided with spaces 58*a* adjacent to the end surfaces of the guide teeth 55 are formed between the vane portions 57. Likewise, guide teeth 65 are formed at an outer circumferential portion 63 of the inner rotor 52 by outer teeth 64, which are continuous in the circumferential direction. The width of the guide teeth 65 is less than the width of the inner rotor 52, and the guide teeth 65 are formed to extend in the width direction to one end surface of the inner rotor 52. The tooth surface of the guide teeth 65 has a trochoid profile. Further, a vane portion 67 extending in the width direction to the other end surface 52*a* of the inner rotor 52 is formed at each tooth tip portion 66 of the guide teeth 65. An end surface 67*a* of the vane portion 67 extending radially outward from the outer circumferential portion 63 of the inner rotor 52 is formed to extend to the tooth tip position identical to that of the tooth tip portion 66 of the guide teeth 65. A plurality of vane portion 67 arranged with a predetermined spacing in the circumferential direction are thus formed at the inner rotor 52, and cutout portions 68 provided with spaces 68*a* adjacent to surfaces of the guide teeth 65 are formed between the vane portions 67. Even when the vane portions 57 and 67 are thus formed only at one end side of the guide teeth 55 and 65, similar effects to those of the abovementioned oil pump 10 can be obtained.

Figure 7:
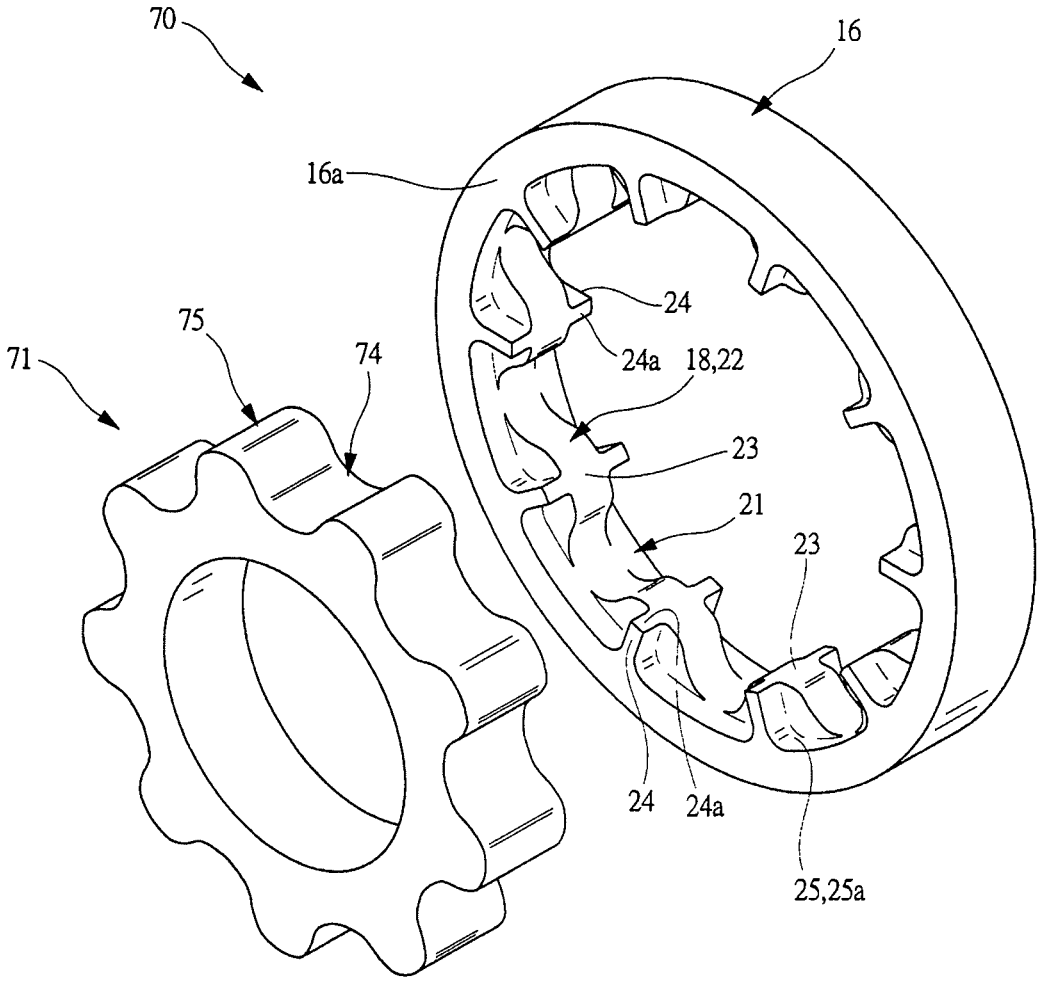
FIG. 7 is an exploded perspective view of an outer rotor and inner rotor provided in an oil pump (internal-gear type fluid device) that is another embodiment of the present invention.
Figure 8:
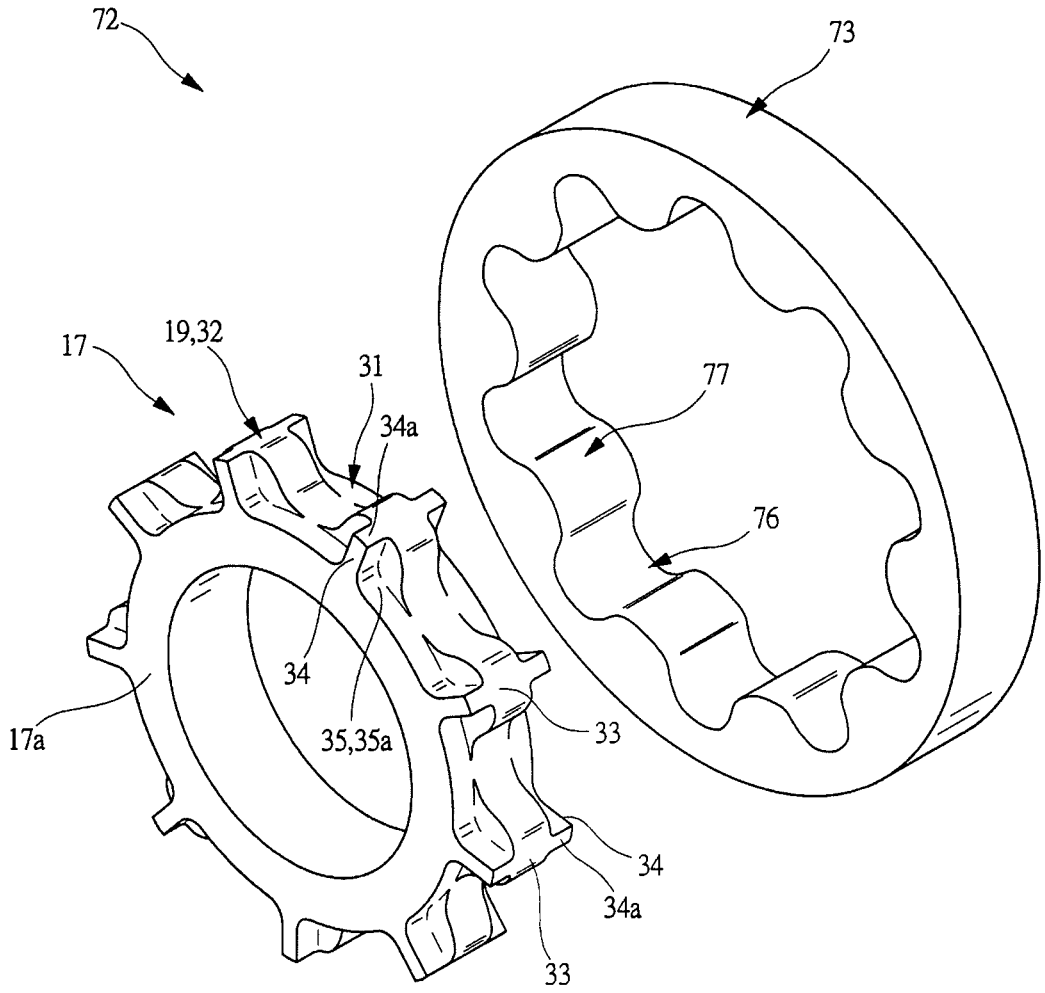
FIG. 8 is an exploded perspective view of an outer rotor and inner rotor provided in an oil pump (internal-gear type fluid device) that is another embodiment of the present invention.

In the explanation above, the vane portions 24, 34, 57 and 67 are formed at both the outer rotors 16 and 51 and the inner rotors 17 and 52. However, the present invention is not limited to such a configuration, and the vane portions 24, 34, 57 and 67 may be formed only at the outer rotors 16 and 51 or the inner rotors 17 and 52. FIG. 7 is an exploded perspective view illustrating an outer rotor 16 and an inner rotor 71 of an oil pump (internal-gear type fluid device) 70 that is another embodiment of the present invention. FIG. 8 is an exploded perspective view illustrating an outer rotor 73 and an inner rotor 17 of an oil pump (fluid device of an inner gear type) 72 that is another embodiment of the present invention. In FIGS. 7 and 8, components same as those shown in FIG. 3B are denoted by same reference symbols and the explanation thereof is omitted. As shown in FIG. 7, a configuration may be used in which vane portions 24 are formed at the inner circumferential portion 21 of the outer rotor 16, and an outer circumferential portion 74 of an inner rotor 71 is constituted only by outer teeth 75. Also, as shown in FIG. 8, a configuration may be used in which vane portions 34 are formed at the outer circumferential portion 31 of the inner rotor 17, and an inner circumferential portion 76 of an outer rotor 73 is constituted only by inner teeth 77. Even when the vane portions 24 and 34 are thus formed only at the outer rotor 16 or the inner rotor 17, similar effects to those of the abovementioned oil pump 10 can be obtained.

The present invention is not limited to the abovementioned embodiments, and various changes can be made without departing from the essence of the invention. For example, in the description above, the oil pump 10 pumping lubricating oil or the like is explained as an internal-gear type fluid device, but the present invention may be also applied to any pump pumping liquid as an internal-gear type fluid devices, and the present invention may be also applied to a fluid motor (hydraulic motor), which use pumped fluid as a power source, as an internal-gear type fluid devices. Further, the inner teeth 18 of the outer rotor 16 and the outer teeth 19 of the inner rotor 17 are formed by trochoid profiles. However, the present invention is not limited to such a configuration, and the inner teeth 18 and the outer teeth 19 may be also formed by using another curve profile.

What is claimed is:

1. An internal-gear type fluid device comprising:

a housing provided with an inlet port and an outlet port; an outer rotor rotatably housed in the housing; and an inner rotor installed inside the outer rotor, wherein a plurality of fluid chambers defined between the outer rotor and the inner rotor move to be subjected to an inlet stroke in which the fluid chambers communicate with the inlet port thereby enlarging the chamber volume, an outlet stroke in which the fluid chambers communicate with the outlet port thereby reducing the chamber volume, and a confinement stroke which is positioned between the inlet stroke and the outlet stroke and in which the chamber volume is at a maximum;

at least either one of an inner circumferential portion of the outer rotor and an outer circumferential portion of the inner rotor has guide teeth constituted by inner teeth or outer teeth continuous in a circumferential direction, the guide teeth being configured to have a width less than that of the rotor, and vane portions are formed to extend in a width direction from tooth tip portions of the guide teeth to an end surface of the rotor;

before a volume of a fluid chamber in the confinement stroke reaches a maximum, the fluid chamber in the confinement stroke and a fluid chamber in the intake stroke communicate with each other via a space between the vane portions disposed with a predetermined spacing in the circumferential direction, but the fluid chamber in the confinement stroke and the fluid chamber in the outlet stroke are cut off from each other by the vane portion;

when the volume of the fluid chamber in the confinement stroke reaches the maximum, the fluid chamber in the confinement stroke and the fluid chamber in the outlet stroke are cut off from each other by the vane portion and the fluid chamber in the confinement stroke and the fluid chamber in the inlet stroke are cut off from each other by the vane portion; and after the volume of fluid chamber in the confinement stroke reaches the maximum, the fluid chamber in the confinement stroke and the fluid chamber in the inlet stroke are cut off from each other by the vane portion, but the fluid chamber in the confinement stroke and the fluid chamber in the outlet stroke communicate with each other via the space between the vane portions.

2. The internal-gear type fluid device according to claim 1, wherein an end surface of the vane portion extending radially from the rotor is formed at a tooth tip position identical to a tooth tip position of the guide tooth.

3. The internal-gear type fluid device according to claim 1, wherein the plurality of fluid chambers disposed in the inlet stroke communicate with one another via spaces between the vane portions, and the plurality of fluid chambers disposed in the outlet stroke communicate with one another via spaces between the vane portions.

4. The internal-gear type fluid device according to claim 2, wherein the plurality of fluid chambers disposed in the inlet stroke communicate with one another via spaces between the vane portions, and the plurality of fluid chambers disposed in the outlet stroke communicate with one another via spaces between the vane portions.

5. The internal-gear type fluid device according to claim 1, wherein the vane portions are formed at both the outer rotor and the inner rotor.

6. The internal-gear type fluid device according to claim 2, wherein the vane portions are formed at both the outer rotor and the inner rotor.

7. The internal-gear type fluid device according to claim 3, wherein the vane portions are formed at both the outer rotor and the inner rotor.

8. The internal-gear type fluid device according to claim 4, wherein the vane portions are formed at both the outer rotor and the inner rotor.

9. The internal-gear type fluid device according to claim 1, wherein an axial direction in the fluid device is defined as one that extends perpendicular to the radial directions of the inner and outer rotors, and at least one of the inner rotor and the outer rotor comprises a vane portion that extends to an axial forward surface of the respective rotor from a tooth tip portion, and a vane portion that extends to an axial rearward surface of the respective rotor from a tooth tip portion.

* * * * *